US006602095B2

(12) United States Patent
Astbury, Jr. et al.

(10) Patent No.: US 6,602,095 B2
(45) Date of Patent: Aug. 5, 2003

(54) SHIELDED WAFERIZED CONNECTOR

(75) Inventors: Allan L Astbury, Jr., Amherst, NH (US); Thomas S. Cohen, New Boston, NH (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 10/131,055

(22) Filed: Apr. 24, 2002

(65) Prior Publication Data

US 2002/0111069 A1 Aug. 15, 2002

Related U.S. Application Data

(62) Division of application No. 09/769,868, filed on Jan. 25, 2001, now Pat. No. 6,409,543.

(51) Int. Cl.[7] ..... H01R 13/648
(52) U.S. Cl. ..... 439/608; 439/608
(58) Field of Search ..... 439/608, 607, 439/609, 610, 606; 29/883, 856, 858, 855, 848

(56) References Cited

U.S. PATENT DOCUMENTS 6,146,202 A * 11/2000 Ramey et al. ..... 439/608
6,168,469 B1 * 1/2001 Lu ..... 439/608
6,171,149 B1 * 1/2001 Van Zanten ..... 439/608
6,174,202 B1 * 1/2001 Mitra ..... 439/608
6,231,391 B1 * 5/2001 Ramey et al. ..... 439/608
6,238,245 B1 * 5/2001 Stokoe et al. ..... 439/608
6,293,827 B1 * 9/2001 Stokoe ..... 439/608
6,299,483 B1 * 10/2001 Cohen et al. ..... 439/608
6,322,379 B1 * 11/2001 Ortega et al. ..... 439/108
6,343,955 B2 * 2/2002 Billman et al. ..... 439/608
6,347,962 B1 * 2/2002 Kline ..... 439/608
6,379,188 B1 * 4/2002 Cohen et al. ..... 439/608
6,409,543 B1 * 6/2002 Astbury, Jr. et al. ..... 439/608

* cited by examiner

*Primary Examiner*—P. Austin Bradley
*Assistant Examiner*—Ross Gushi
(74) *Attorney, Agent, or Firm*—Teradyne Legal Dept.

(57) ABSTRACT

A high speed, high density electrical connector. The connector is assembled from wafers. Each wafer is formed by molding a first dielectric housing over a shield plate. Signal contacts are inserted into the first dielectric housing and a second housing is overmolded on the first housing. Features are employed to lock the first and second housings together with the shield plate to provide a mechanically robust subassembly. The connector as formed has a good electrical properties, including precise impedance control and low cross talk.

7 Claims, 10 Drawing Sheets

SHIELDED WAFERIZED CONNECTOR

RELATED APPLICATIONS

This application is a divisional of copending U.S. Ser. No. 09/769,868 filed Jan. 25, 2001, now U.S. Pat. No. 6,409,543 B1.

BACKGROUND OF THE INVENTION

This invention relates generally to electrical interconnects and more specifically to high speed, high density electrical connectors used to interconnect printed circuit boards.

Modern electronic circuitry is often built on printed circuit boards. The printed circuit boards are then interconnected to create a complete system, such as a computer work station or a router for a communications network. Electrical connectors are often used to make the interconnections. In general, the connectors come in two pieces, with one piece on each board. The connector pieces mate to provide signal paths between the boards.

A good connector must have a combination of several properties. It must provide signal paths with appropriate electrical properties such that the signals are not unduly distorted as they move between boards. In addition, the connector must ensure that the pieces mate easily and reliably. Further, the connector must be rugged, so that it is not damaged by handling of the printed circuit boards. In many systems, it is also important that the connectors have a high density, meaning they can carry a large number of electrical signal per unit length.

Examples of very successful high speed, high density electrical connectors are the VHDM™ and VHDM-HSD™ connectors sold by Teradyne Connection Systems of Nashua, N.H., USA.

It would, however, be desirable to provide an even better electrical connector. It is also desirable to provide simplified methods of manufacturing connectors.

SUMMARY OF THE INVENTION

It is an object of the present invention to provide an improved high speed, high density electrical connector.

The foregoing and other objects are achieved in an electrical connector assembled from wafers. Each wafer includes a shield member, signal members and an insulative housing. The wafers are formed in a plurality of molding steps that encapsulate the shield member and signal members in the insulative housing in a predetermined relationship.

In the preferred embodiment, insulator is molded around the shield, leaving spaces to receive the signal contacts. The signal contacts are then placed into the spaces and a second molding operation is performed, leaving an interlocked molded housing.

According to other features of the preferred embodiment, the shield and plastic housing are shaped to provide mechanical integrity for the wafers.

BRIEF DESCRIPTION OF THE DRAWINGS

The foregoing and other objects, features and advantages of the invention will be apparent from the following more particular description of a shielded waferized connector, as illustrated in the accompanying drawings in which like reference characters refer to the same parts throughout the different views. For clarity and ease of description, the drawings are not necessarily to scale, emphasis instead being placed upon illustrating the principles of the invention.

DETAILED DESCRIPTION OF THE INVENTION

Figure 1:
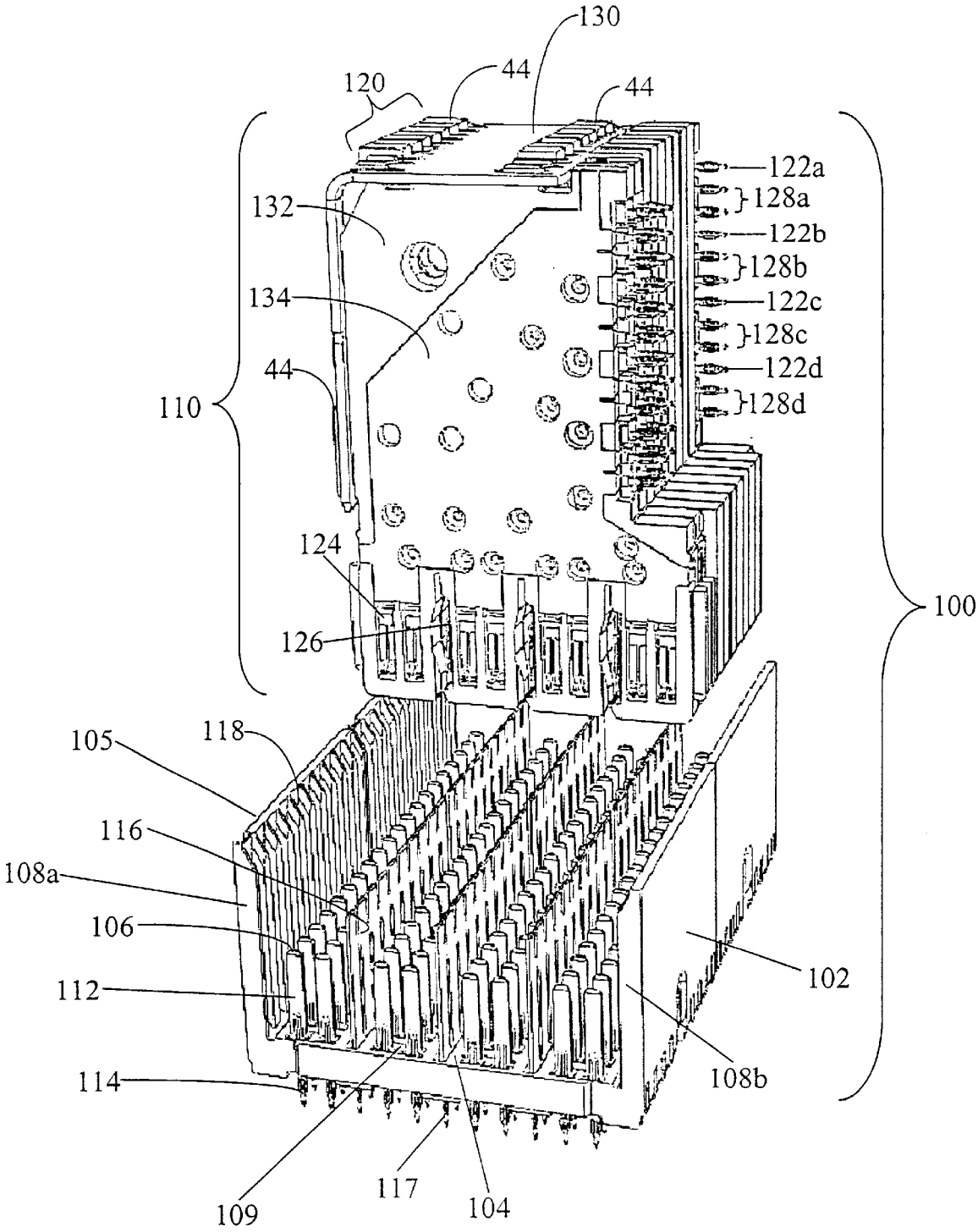
FIG. 1 is a diagram of a two piece, modular electrical connector.

Referring to FIG. 1, a two piece electrical connector 100 is shown to include a backplane connector 105 and a daughtercard connector 110. The backplane connector 105 includes a backplane shroud 102 and a plurality of signal contacts 112, here, arranged in an array of differential signal pairs. A single-ended configuration of the signal contacts 112 is also contemplated. In the illustrated embodiment, the backplane shroud 102 is molded from a dielectric material such as a liquid crystal polymer (LCP), a polyphenyline sulfide (PPS) or a high temperature nylon.

The signal contacts 112 extend through a floor 104 of the backplane shroud 102 providing a contact area both above and below the floor 104 of the shroud 102. Here, the contact area of the signal contacts 112 above the shroud floor 104 are in the form of a blade contact 106. The tail portion 114 contact area of the signal contact 112 which extends below the shroud floor 104 here, is in the form of a press fit, "eye of the needle" compliant contact. However, other configurations are also suitable such as surface mount elements, spring contacts, solderable pins, etc. In a typical configuration, the backplane connector 105 mates with the daughtercard connector 110 at the blade contacts 106 and connects with signal traces in a backplane (not shown) through the tail portions 114 which are pressed into plated through holes in the backplane.

The backplane shroud 102 further includes side walls 108*a*, 108*b* which extend along the length of opposing sides of the backplane shroud 102. The side walls 108*a*, 108*b* include grooves 118 which run vertically along an inner surface of the side walls 108*a*, 108*b*. Grooves 118 serve to guide the daughtercard connector 110 into the appropriate position in shroud 102. Running parallel with the side walls 108*a*, 108*b* are a plurality of shield plates 116 located here, between rows of pairs of signal contacts 112. In a singled ended configuration, the plurality of shield plates 116 would be located between rows of signal contacts 112. However, other shielding configurations could be formed, including having the shield plates 116 running between the walls of the shrouds, transverse to the direction illustrated.

Each shield plate 116 includes a tail portion 117 which extends through the shroud base 104. Here, the tail portion 117 is formed as an "eye of the needle" compliant contact which is press fit into the backplane however, other configurations are also suitable such as surface mount elements, spring contacts, solderable pins, etc.

The daughtercard connector 110 is shown to include a plurality of modules or wafers 120 which are supported by a stiffener 130. Each wafer 120 includes features 44 which are inserted into apertures (not numbered) in the stiffener to locate each wafer 120 with respect to another and further to prevent rotation of the wafer 120.

Figure 2:
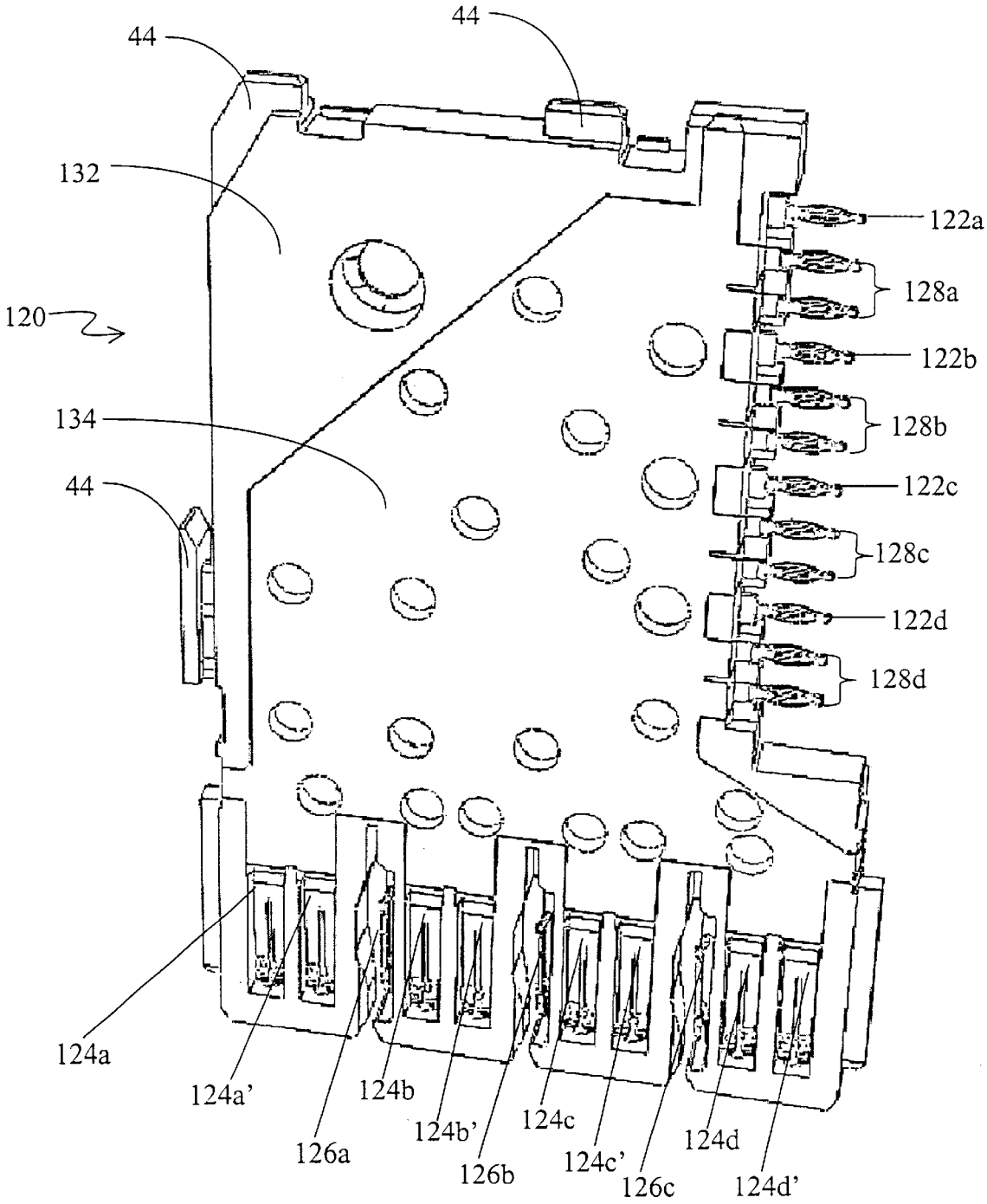
FIG. 2 is a diagram of a wafer of FIG. 1 assembled according to one embodiment of the invention.

Referring now to FIG. 2, a single wafer is shown. Wafer 120 is shown to include a dielectric housing 132, 134 which is formed around both a daughtercard shield plate 10 (FIG. 3) and a signal lead frame 60 (FIG. 5). A preferred manner of forming the dielectric housing around the shield plate 10 and signal lead frame 60 will be discussed in detail in conjunction with FIGS. 3–9.

Extending from a first edge of each wafer 120 are a plurality of signal contact tails 128*a*–128*d*, which extend from the signal lead frame 60, and a plurality of ground contact tails 122*a*–122*d*, which extend from a first edge of the shield plate 10. In the preferred embodiment, the plurality of signal contact tails 128*a*–128*d* and the plurality of ground contact tails 122*a*–122*d* are arranged in a single plane.

Here, both the signal contact tails 128*a*–128*d* and the ground contact tails 122*a*–122*d* are in the form of press fit "eye of the needle" compliants which are pressed into plated through holes located in a printed circuit board (not shown). Other configurations for the signal contact tails 128*a*–128*d* and ground contact tails 122*a*–122*d* are also suitable such as surface mount elements, spring contacts, solderable pins, etc. Here, the signal contact tails 128 are configured to provide a differential signal and, to that end, are arranged in pairs 128*a*–128*d*.

Near a second edge of each wafer 120 are mating contact regions 124 of the signal contacts which mate with the signal contacts 112 of the backplane connector 105. Here, the mating contact regions 124 are provided in the form of dual beams to mate with the blade contact 106 end of the backplane signal contacts 112. The mating contact regions are positioned within openings in dielectric housing 132 to protect the contacts. Openings in the mating face of the wafer allow the signal contacts 112 to also enter those openings to allow mating of the daughter card and backplane signal contacts.

To carry a differential signal, the beams 124 are configured in pairs 124*a*–124*d*, 124*a*'–124*d*'. In a single-ended configuration, the beams 124 are not provided in pairs.

Provided between the pairs of dual beam contacts 124 and also near the second edge of the wafer are shield beam contacts 126*a*–126*c*. Shield beam contacts are connected to daughtercard shield plate 10 and are preferably formed from the same sheet of metal used to form shield plate 10. Shield beam contacts 126*a* . . . 126*c* engage an upper edge of the backplane shield plate 116 when the daughtercard connector 110 and backplane connector 105 are mated. In an alternate embodiment (not shown), the beam contact is provided on the backplane shield plate 116 and a blade is provided on the daughtercard shield plate 10 between the pairs of dual beam contacts 124. Thus, the specific shape of the shield contact is not critical to the invention.

As mentioned above, the wafers include a dielectric housing 132, 134. The wafers 120 are, in the preferred embodiment, produced by a two step molding process. The first housing 132 of dielectric material is formed over the top surface of the daughtercard shield 10. The signal lead frame 60 (FIG. 5) is placed on the surface of the first housing 132 and the second dielectric housing 134 is formed over the signal lead frame 60, encapsulating the signal lead frame 60 between the first and second dielectric housings 132, 134. The two-step molding process is described in further detail in conjunction with FIGS. 3–9.

Figure 3:
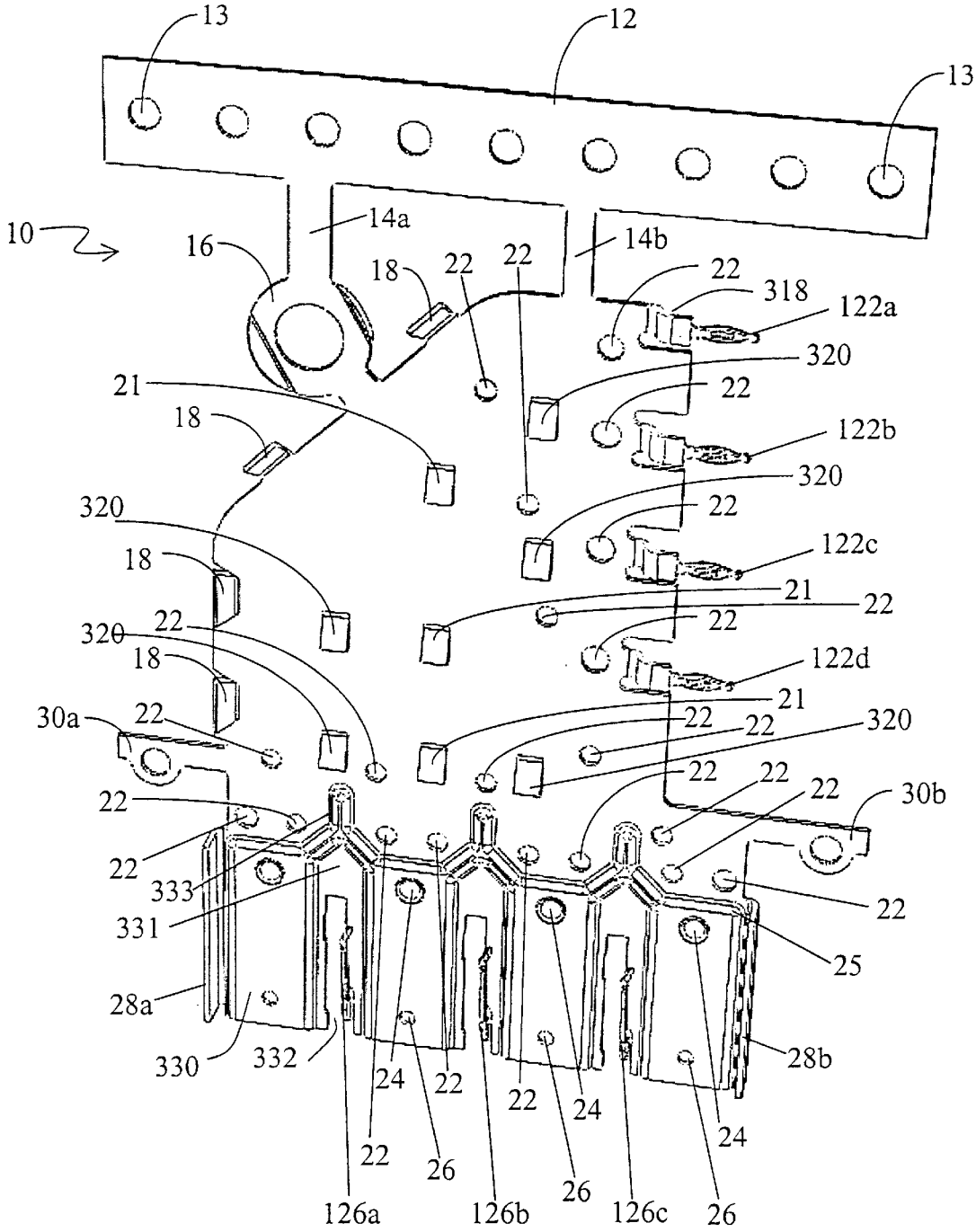
FIG. 3 is a diagram of a shield plate.

Referring now to FIG. 3, the daughtercard shield 10 is shown attached to a carrier strip 12. Typically, a plurality of daughtercard shields are provided on a carrier strip 12 which can be fed into assembly equipment. The carrier strip 12 is shown to include a series of apertures. Here, the apertures located at each end of the carrier strip are used as alignment holes 13. In a preferred embodiment, the plurality of shields and the carrier strip are stamped and formed from a long sheet of metal.

In the illustrated embodiment, the daughtercard shield 10 is attached to the carrier strip 12 at two locations, generally referred to as tie bars 14*a*, 14*b*. Adjacent shields 10 are attached at points indicated by carrier strips 30*a* and 30*b*. The carrier strips 14 and 30 are left in place to provide mechanical support and to aid in handling the wafer during manufacturing, but are severed at any convenient time before daughter card connector 110 (FIG. 1) is assembled.

Various features are formed into daughtercard shield 10. As described above, dielectric housing 132 is molded on the upper surface of shield 10. A plurality of tabs 18 and 21 are formed in shield 10 and bent above the upper surface. When dielectric housing 132 is molded on this surface of shield plate 10, tabs 18 and 21 become embedded in dielectric housing and secure shield 10 to dielectric housing 132. Thus, these features enhance the mechanical integrity of the wafer 120.

A second group of tabs 320 is also formed on the upper surface of shield 10. As will be shown more clearly in connection with FIG. 4, tabs 320 become embedded in dielectric housing 134 and further promote mechanical integrity of wafer 120 by ensuring the shield and both dielectric housings are secured together.

Additionally, tabs 318 are formed from the plate. Tabs 318 serve multiple purposes. As with tabs 18, 20 and 320, tabs 318 assist in securing the plate 10 to the dielectric housing. Additionally, tabs 318 serve as a point of attachment for contact tails 122*a* . . . 122*d*. Because tabs 318 are bent above the plane of shield 10, contact tails 122*a* . . . 122*d* align with signal contact tails 128*a* . . . 128*d* to form a single column of contact tails for each wafer. As a further benefit, tabs 318 position the contact tails 122*a* . . . 122*d* within the dielectric housing and make them less susceptible to bending when the contact tails 122*a* . . . 122*d* are pressed into a printed circuit board. As a result, the connector is more robust.

Ring 16 is an example of an alignment feature that can be used during manufacture of the connector elements. At various steps in the manufacture of the connector, the components need to be aligned relative to tooling or to each other. For example, the shield 10 needs to be aligned relative to the mold or to tools when selective metalization of the contact regions on the shield plate are required. Ring 16 is outside of the path of the signal contacts and therefore has little impact on the shielding effectiveness of shield 10 and is preferably severed when no longer needed for alignment. Ring 16 includes tabs (not numbered) that become embedded into the housing to hold ring 16 in place after it is severed, thereby keeping ring 16 from interfering with operation of the connector.

Shield 10 contains additional features. Holes 22 are included in shield plate 10 to allow access to the internal portions of wafer 120 at later steps of the manufacturing operation. Their use is described later in conjunction with FIG. 7.

The front edge of shield plate 10 includes slots 332. Each of the slots 332 receives a backplane shield 116 when the connector pieces are mated. Also, the metal cut out to form the slot 332 is formed into a shield beam contact 126.

Because cutting slots 332 reduces the mechanical integrity of the front of shield 10, raised portions 330 and raised ribs 333 can be formed near the front edge of shield 332. Forming raised portions increases the stiffness of the shield in this region. The raised portions also move the shield plate 10 of one wafer away from the adjacent wafer and create a recessed area. During molding, the recessed area becomes filled with molding material to create a dielectric region (element 912, FIG. 9). As shown in FIG. 1, signal contacts 124 are exposed at the top of the wafer. When the daughter cared and backplane connectors mate, blades 106 will press signal contacts 124 will be biased upward, or toward the shield plate of the adjacent wafer. Dielectric region 912 prevents the signal contacts on one wafer from contacting the shield plate of the adjacent wafer.

In the illustrated embodiment, slot 332 does not extend the entire length of raised portions 330. There is a flat region 331 above each slot 332. Flat region 331 is included for engaging a backplane connector having a castellated upper edge as shown in FIG. 1.

Holes 26 are also included in the plate in raised portions 330. As dielectric housing 132 is molded onto shield 10, dielectric material will flow through holes 26, thereby locking the dielectric to the shield 10, providing greater stiffness at the front end of the connector. Holes 24 are also included in shield 10. Holes 24, like holes 26, are used to lock the pieces of the connector together. Holes 24 are filled when dielectric housing 134 is molded, thereby locking dielectric housing to shield 10.

Shield 10 also may include features to increase the signal integrity of the connector. Projections 28*a* and 28*b* are included to provide shielding around the end row contacts. When the connector halves are mated, the interior mating contact regions 124*b* and 124*c* will each be between shield plates 116 from the backplane connector. However, the exterior mating contact regions 124*a* and 124*d* will each have a shield plate 116 from the backplane connector on only one side. Because the spacing and shape of the ground conductors around a conductor influence the signal carrying properties of that conductor, it is sometimes desirable to have grounded conductors on all sides of a conductor, particularly in the mating contact region.

For the interior mating contact regions 124*b* and 124*c*, the shield 10 of the wafer 120 in which the signal contacts are attached and the shield 10 of the adjacent wafer provide a ground plane on two sides of the mating contacts. The other two sides are shielded by two of the backplane shields 116, to create a grounded box around the mating portions of the signal conductors. For the exterior mating contact portions, a grounded box around the mating portions is also created, with the four sides being made up of the shields 10 from two adjacent wafers 120, a backplane shield 116 and one of the projections 28*a* or 28*b*. Thus, the exterior mating contact portions 124*a* and 124*d* benefit from ground conductors on all four sides. Overall, it is desirable that all signal conductors have symmetric shielding that is similar for all pairs of conductors.

Figure 4:
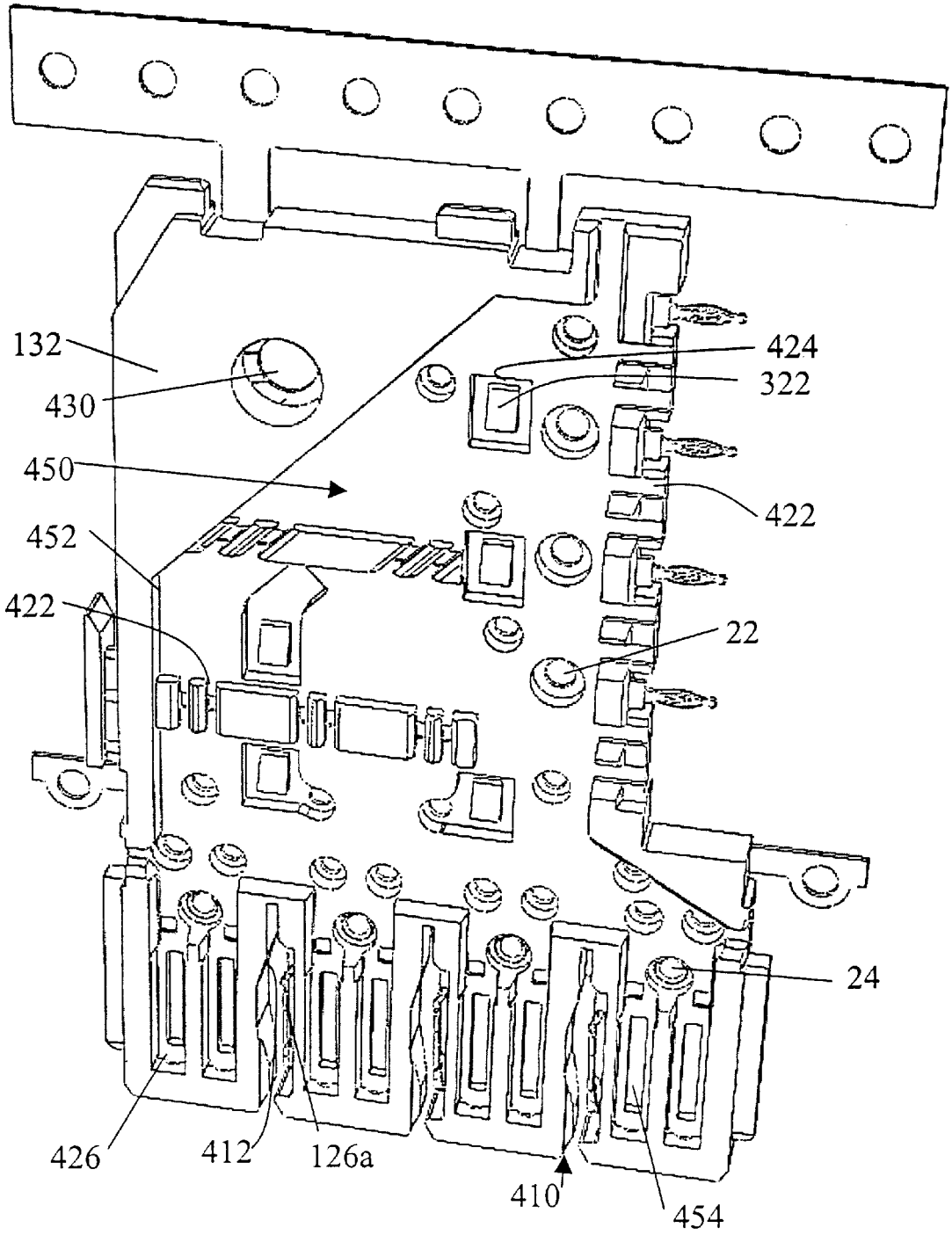
FIG. 4 is a diagram of a wafer subassembly including the shield plate of FIG. 3.
Figure 5:
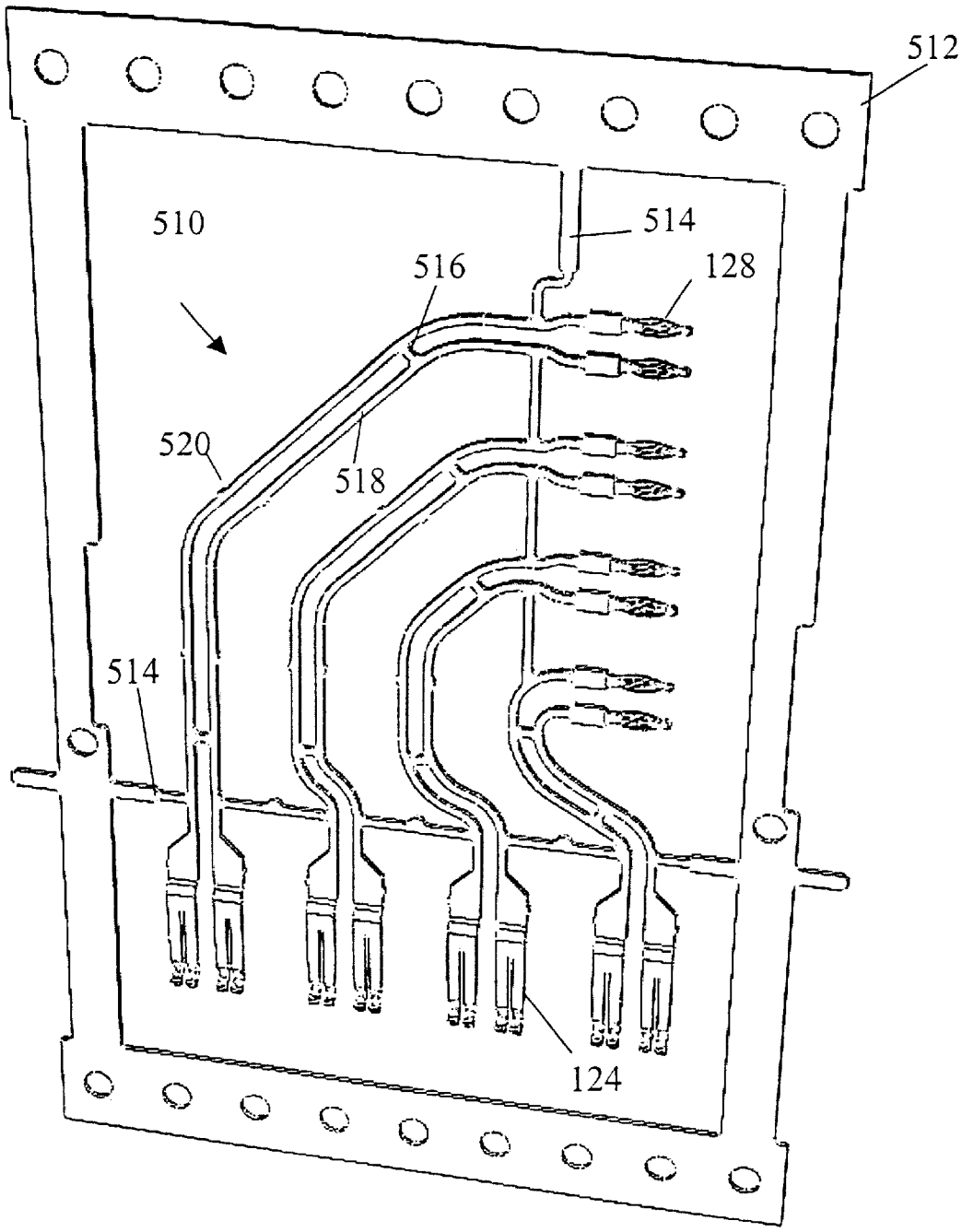
FIG. 5 is a diagram of a signal lead frame.

Turning now to FIG. 4, a wafer in the next step of manufacture is shown. In this figure, dielectric housing 132 is shown molded over a shield 10. Insert molding is known in the art and is used in the connector art to provide conductors within a dielectric housing. In contrast with prior art connectors, dielectric material is molded over the majority of the surface of shield 10. Additionally, the dielectric is largely on the upper surface of shield, leaving the lower surface of the shield exposed.

Tabs 18, 318 and 20 are not visible in FIG. 4. Tabs 18, 318 and 20 are embedded in dielectric housing 132. Tabs 322 are visible because dielectric housing 132 is molded to leave windows 424 around tabs 322. Likewise, holes 22 and 24 are visible because no dielectric housing has been molded around them. Holes 26 are not visible, however, because dielectric housing 132 has been molded to fill those holes and to fill the open spaces behind raised portions 330.

Various features are molded into dielectric housing 132. Cavity 450 bounded by walls 452 is left generally in the central portions of the housing 132. Channels 422 are formed in the floor of cavity 450 by providing closely spaced projecting portions of dielectric housing. As shown more clearly in FIG. 6, channels 422 are used to position signal conductors. Also, openings 426 are molded to allow a mating contact area for each signal contact. The front face of dielectric housing 132 creates the mating face of the connector and contains holes to receive blades 106 from the backplane connector, as is known in the art. The walls of opening 426 protect the mating contact area.

In the illustrated embodiment, the floor of opening 426 has a recess 454 formed therein. Shield plate 10 is visible through recess 454. When the connector pieces are mated, a blade 106 enters opening 426 through the front mating face and is pressed against the floor of opening 426 by a signal contact 124. Thus a recess 454 will be between the blade 106 and the shield, leaving an air space. The air space formed by recess 454 increases the impedance of the signal path in the vicinity of the mating interface, which is otherwise a low impedance section of the signal path. It is desirable to have the impedance of the signal path uniform throughout.

Slots 410 are molded to expose slots 332 and shield beam contacts 126. Slots 410 receive shield plates 116 from the backplane connector, which make electrical connection to shield beam contacts 126. Slots 410 each have a tapered surface 412 opposing the shield beam contact 126. As the backplane and daughter card connectors mate, a shield plate 116 will enter a slot 410. The shield plate 116 could be pressed towards tapered surface 412 by the spring action of shield beam contacts 126. The taper of tapered surface 412 guides the leading edge of the backplane shield plate 116 into position at the far end of slot 410, thereby preventing stubbing of the shield plate during mating of the connectors.

Hole 430 is left in dielectric housing 132 to allow access to ring 16 for the purpose of severing tie bar 14a from shield plate 10. Severing the tie bars close to the signal and ground contacts reduces the stubs attached to the signal and ground members. Stubs are sometimes undesirable at high frequencies because they change the electrical properties of the device.

Turning now to FIG. 5, signal contact blank 510 is shown. Signal contact blank 510 is stamped and formed from a long sheet of metal. Numerous signal contact blanks are formed from a sheet of metal, with the signal contact blanks being held together on carrier strips 512. The carrier strips 512 can include holes for indexing or to otherwise facilitate handling on the carrier strips.

As can be seen in FIG. 5, each of the signal contacts is stamped and formed to have the required mating contact region 124 and contact tail 128. Additionally, each signal contact has an intermediate portion 518 joining the contact region and the contact tail.

As initially formed, the signal contacts are held together with tie bars 516 and held to the carrier strips with tie bars 514. These tie bars provide mechanical stability to signal contact blank while the connector is being assembled. However, they must be severed before the connector is used. Otherwise, they would short out the signal contacts. A method of severing the tie bars is shown in connection with FIG. 7.

Signal contact blank 510 is preferably stamped from metal. A metal traditionally used in the connector is preferred, with a copper based beryllium alloys and phosphor-bronze being suitable metals. Portions of the signal contacts, particularly the contact region can be coated with gold if desired to reduce oxidation and improve the reliability of the electrical connections.

The signal contacts also include projections 520. As described above, the signal contacts are placed into channels 422 in dielectric housing 132. Projections 520 grip the walls of the channels 422 to hold the signal contacts in place.

Figure 6:
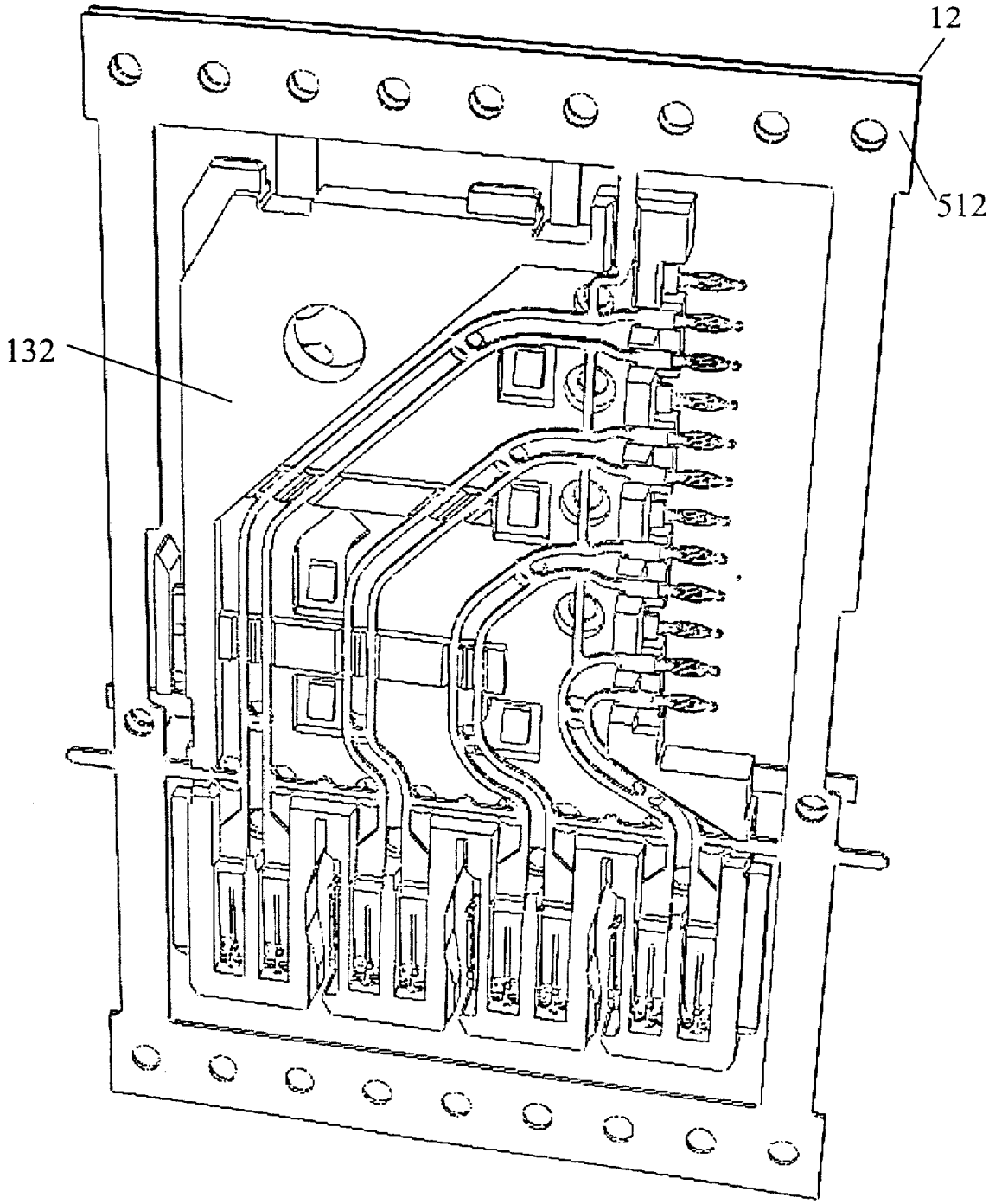
FIG. 6 is a diagram of the signal lead frame of FIG. 5 positioned on the wafer subassembly of FIG. 4.

In the next step of the manufacturing operation, the signal contact blank 510 is overlaid on the dielectric housing 132 as shown in FIG. 4. Wafer 120 in this state of manufacture is shown in FIG. 6. Note that the holes in the carrier strips 12 and 512 are used to line up the signal contacts with the carrier strips for shield 10. Because the molding operation that molded dielectric housing 132 over shield 10 was also based on the holes in carrier strip 12, precise alignment of all parts of the connector is achieved. Tooling to press the signal contacts into the channels 422 can also use those holes for positioning.

Figure 7:
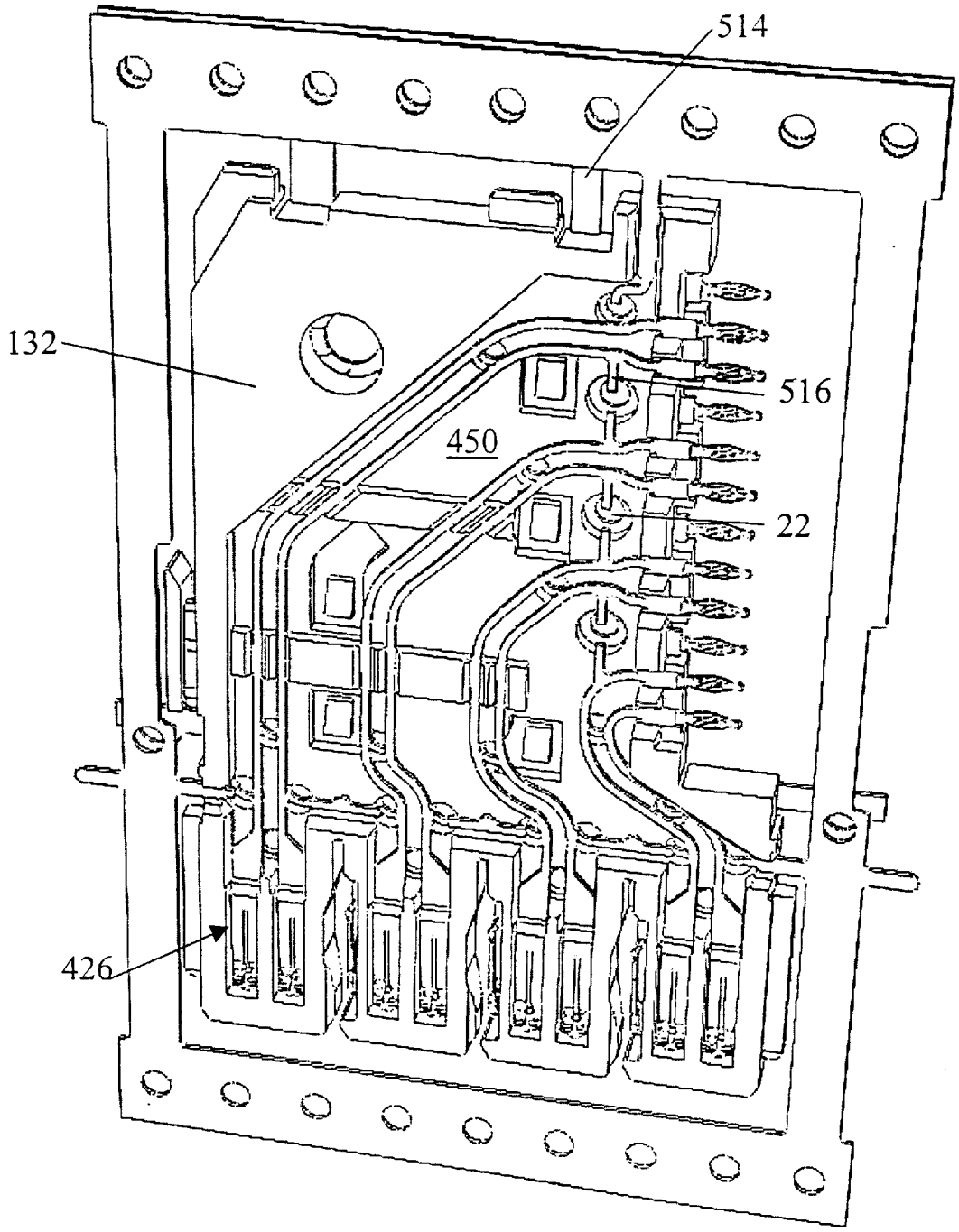
FIG. 7 depicts the assembly of FIG. 6 after the signal lead frame carrier strip tie bars have been severed.

Turning to FIG. 7, the severing of the tie bars is illustrated. Those tie bars 514 that extend beyond the dielectric housing 132 can be easily sheared at a point outside the housing 132. Preferably, they are sheared as close to the housing as possible.

Each of the tie bars 516 that is internal to the dielectric housing 132 passes over a hole 22. A tool can be inserted through the hole, thereby severing the tie bars 516.

Then, the wafer is subjected to a second molding operation. In this operation, cavity 450 is filled to create dielectric housing 134 (FIG. 2). Openings 426 are not filled, however, to allow mating contact regions 124 to move freely and provide the required mating force.

Figure 8:
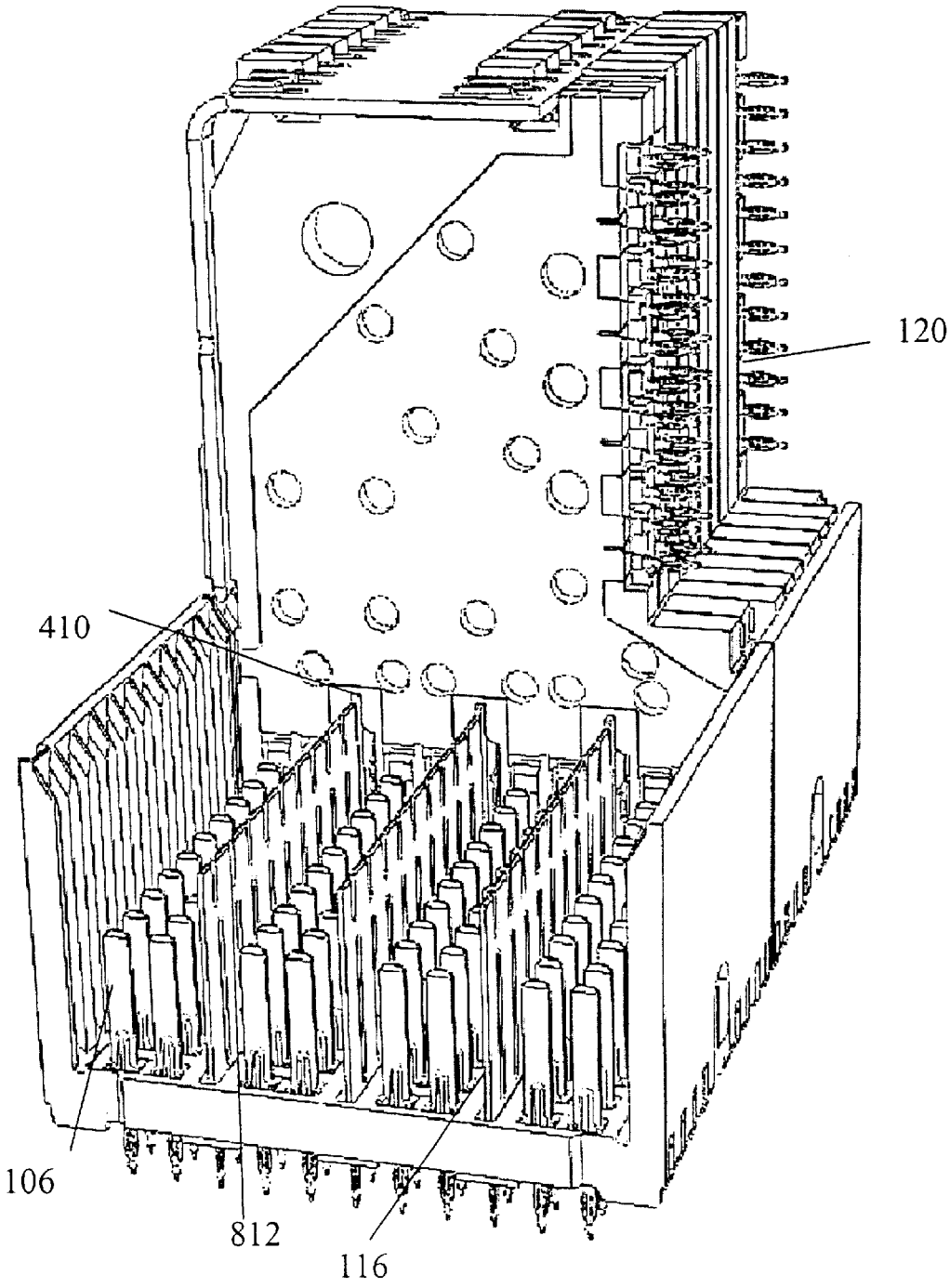
FIG. 8 is a diagram showing the wafers mated with the backplane connector.

FIG. 8 shows the wafers 120 assembled into a connector mated to a backplane connector. Blades 106 engage with the signal contacts 124. The backplane shield plates 116 are inside slots 410 and engage with shield beam contacts 126.

In the illustrated embodiment, the shield plates 116 have a plurality of slots 812, to form castellations along the upper edges of shield plates 116. Each of the slots 812 engages a flat region 331 (FIG. 3), which is left exposed in slot 410 (FIG. 4) when housing 132 is molded. Slots 812 reduces the required depth of slots 332 formed in shield plate 10 (FIG. 3), but allows the shield plates 116 to be longer in the regions where they mate with shield beam contacts 126. Reducing the required depth of slots 332 improves the mechanical integrity of the wafer. Allowing longer shield plates increases the amount of "advance mating," which can be desirable. Advance mating refers to the distance between the point where the ground contacts mate and the signal contacts mate as the daughter card and the backplane connectors are being pushed together during connector mating.

Figure 9:
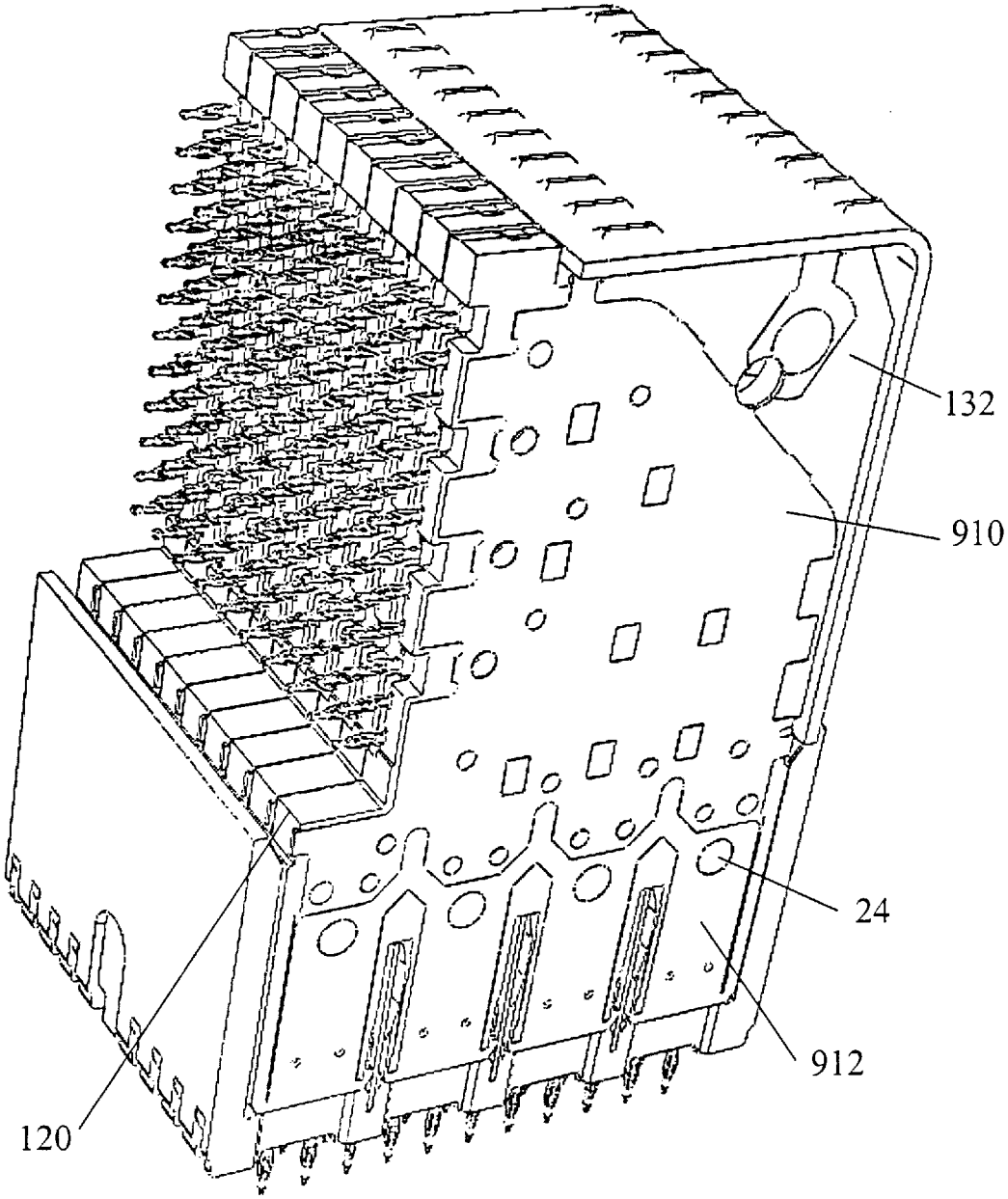
FIG. 9 shows the wafers mated with the backplane connector from the reverse angle.

Turning now to FIG. 9, a mated wafer 120 is shown from the shield side. As described above, dielectric housing 132 is molded on the upper surface of shield 10. Thus, on the side of wafer 120 visible in FIG. 9, the lower surface 910 of shield 10 is visible. Raised portions 330 (FIG. 3) and raised ribs 333 (FIG. 3) on the upper surface of shield 10 create recesses on the lower surface 910. These recesses are filled with dielectric during the molding of dielectric housing 132, leaving dielectric regions 912. Dielectric regions 912 serve multiple purposes. They interact with the plastic that has filled holes 26 (FIG. 3) to lock the dielectric housing 132 to shield plate 10 along the upper edge of wafer 120. They also insulate shield plate 10 from signal contacts 124 in an adjacent wafer. Thus, they reduce the chance that signal contacts will be shorted to ground.

Figure 10:
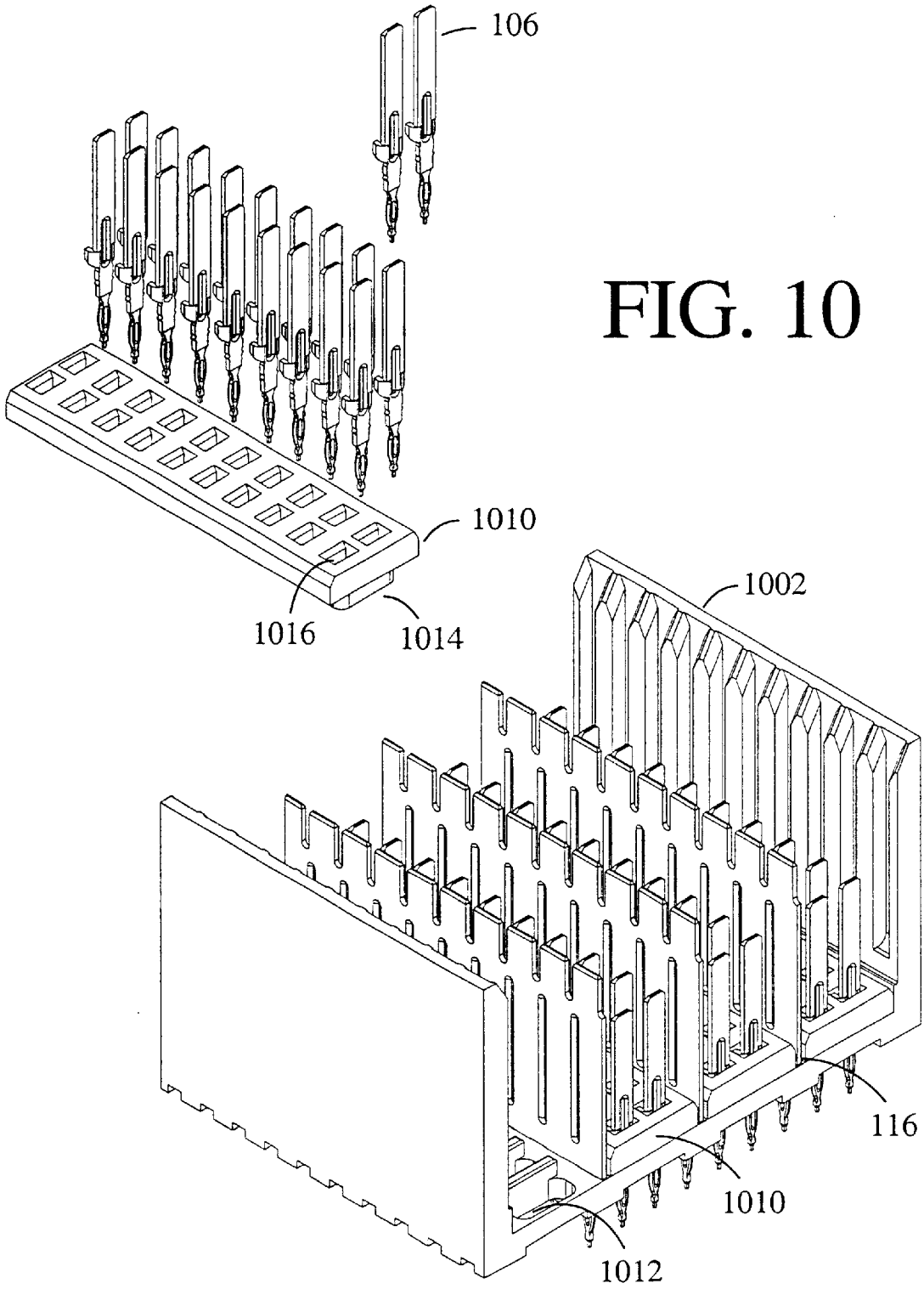
FIG. 10 shows an exploded view of alternative embodiment of the backplane connector.

Turning now to FIG. 10, an alternative embodiment of the backplane connector is shown. In this embodiment, the shroud 1002 is formed from a conductive material. In the preferred embodiment, the conductive material is a metal, such as die cast zinc. Possibly, the metal is coated with chromate or nickel to prevent anodization.

To prevent the blades from shorting to the conductive shroud, dielectric spacers can be inserted into the shroud 1002 and then the blades 106 can be inserted into the spacers. In the preferred embodiment, the dielectric strips are pushed into holes 1012 in the floor of shroud 1002. Each dielectric strip is molded from plastic and includes plugs 1014 on the lower surface to make an interference fit with the holes 1012. Holes 1016 in dielectric strips 1010 receive blades 106. Dielectric strips 1010 simplify manufacture in comparison to traditional dielectric spacers.

There are several advantages of a connector made as described above. One advantage results from the multi-step molding process. The spacing between the signal contacts and the ground plane formed by shield 10 is very tightly controlled. Controlled spacing results in better impedance control, which is desirable.

As another advantage, molding the dielectric housing onto the shield plate 10 reduces the overall thickness of the wafers, allowing a connector with higher density to be formed.

Also, molding dielectric material over dielectric material allows for advantages during the manufacture of the connector. The perimeter of the second dielectric housing 134 overlaps places where the first dielectric housing 132 is already molded. The perimeter of dielectric housing 134 is formed where a wall of a mold shuts off the flow of plastic material during the molding operation. Thus, when second dielectric housing 134 is molded, the mold is clamping down on the dielectric housing 132. Less precision is needed in the molding operation and also greater mold life can be expected when the mold clamps down on plastic, as is the case when second dielectric housing 134 is molded.

Another advantage is that making wafers through an overmolding operation allows a family of connectors to be inexpensively made on different pitches between columns of contacts. The inter-column pitch can be changed by changing the thickness of the overmolding 134. Increasing the pitch might, for example, be done to reduce cross-talk and thereby increase the speed of the connector. It might also be desirable to increase the pitch to allow 10 mil traces to be routed to the connector rather than more stand 8 mil traces. As operating speeds increase, thicker traces are sometimes needed. Using the disclosed design, the same tooling can be used to form housing 132, shields 10 and signal contact blank 510 regardless of the thickness of the wafer. Also, the same assembly tooling might be used. Having so much of the manufacturing process and tooling in common for connectors on different pitches is an important advantage.

Further, the two step molding operation securely locks the contacts tails into the insulative housing for both the shield and signal contacts. Securely locking the contact tails into the housing is particularly important for connectors made with press fit contacts. The contacts receive very high force when the connector is mounted onto a printed circuit board. If the tails are not securely locked into the insulative housing, there is an increased risk that the contacts will bend or crumble, preventing adequate interconnection of the connector to the board.

While this invention has been particularly shown and described with references to preferred embodiments thereof, it will be understood by those skilled in the art that various changes in form and details may be made therein without departing from the scope of the invention encompassed by the appended claims.

For example, the invention is described as applied to a right angle backplane connector. The invention might be employed with connectors in other configurations, such as mezzanine or stacking connectors, which join printed circuit boards that are parallel to each other. The invention might also be used to manufacture cable connectors. To make a cable connector, the contact tails use to attach the connector would be replaced by cables. Often, cables are shielded and the shields of the cable attach to the shields of the connectors. Often the signal contacts of the power connectors do not bend at right angles. The mating interface of a power connector, is however, usually the same as the mating interface of the right angle daughter card connector. Having the same interface allows the power connector to plug into the same backplane connector as the daughter card connector.

As another example, the order of various manufacturing steps might be interchanged. The order in which the tie bars 514 and 516 are severed is not critical to the manufacture of the connector. Tie bars 514 could be severed first and then carrier strips 512 might be removed before dielectric housing 134 is molded. In this way, tie bars can be removed when carrier strips 512 are removed.

Likewise, carrier strips 516 might be severed to separate the signal contacts in a signal contact blank before dielectric housing 134 is molded. If carrier strips 516 are severed after the molding operation, holes 22 are left exposed.

Further, it should be appreciated that the specific shapes of the contact elements are illustrative. Various shapes, sizes and locations for contact elements would be suitable in a connector according to the invention. For example, the shield member does not have to be a single plate, but could instead be formed from a-plurality of shield segments. Further, slots could be formed in the shield plate to reduce resonance in the plate.

As another example, it should be appreciated that tabs, such as 18 and 322 are shown as attachment features that serve to attach the dielectric housings to the shield plate 10. Holes 26 are also illustrations of attachment features. Tabs might be interchanged for holes. Alternatively, attachment features with other shapes might be used.

Also, thermoplastic material is generally used for injection molding, which can be used for the molding steps. Other types of molding could be used. In addition, dielectric housing 134 might not be formed by molding. Rather, it could be formed by filling cavity 450 with an epoxy or other settable material.

Yet further modifications are possible. In the above-described embodiment, a metal stiffener is shown. Other methods of attaching the wafers are possible, including attaching them to plastic support structures or otherwise securing the wafers together.

It should also be appreciated that all of the listed features and advantages described need to be present simultaneously to get benefit of the invention.

What is claimed is:

1. An electrical connector assembled from wafers, comprising:

a) a shield plate having an upper surface and a lower surface, the shield plate having a plurality of contact tails extending therefrom, the contact tails connected to the shield plate through a portion bent to raise the contact tail above the plane of the shield plate;

b) a first dielectric housing molded on the shield plate, the first dielectric housing having a cavity and a plurality of openings extending from the cavity and the first dielectric housing also encapsulating the bent portions attaching the contact tails to the shield plate;

c) a plurality of signal contacts, each of the signal contacts having a contact tail, a contact region and an intermediate portion joining the contact tail and the contact region, the plurality of signal contacts inserted into the first dielectric housing, with the intermediate portions in the cavity, the contact regions in one of the plurality of openings and the contact tails extending from the first dielectric housing; and d) a second dielectric housing molded substantially over the cavity, thereby securing the shield, the first dielectric housing and the signal contacts together as a wafer, whereby the contact tails of the shield plate and the signal contacts are secured.

2. The electrical connector of claim 1, wherein the shield plate has a raised portion forming a recess below the upper surface, the raised portion having a hole therein providing a first portion of the first dielectric housing above the raised portion and providing a second portion of the first dielectric housing in the recess and in the hole, thereby securing the first portion and the second portion.

3. The electrical connector of claim 2 wherein the connector has a face adapted to mate to a second connector and the raised portion is along the edge of the plate at the face.

4. The electrical connector of claim 1 wherein the shield plate has a raised portion and the first dielectric housing includes recessed areas in the floor of the cavity whereby air spaces are provided between the signal contacts and the raised portion of the shield plate.

5. The electrical connector of claim 1 wherein the connector has a face adapted to mate to a second connector and the shield plate has a plurality of slots in the edge adjacent the face, with the front housing having an opening therein exposing the slot and portion of the shield plate away from the face.

6. An electrical connector made from a plurality of wafers, comprising:

a) a shield plate with an upper surface and a lower surface, the plate having raised portions in the upper surface thereby forming recesses in the lower surface;

b) a first insulative housing molded on the upper surface of the shield plate and the lower surface of the shield plate in the recesses, the insulative housing having a cavity therein;

c) signal contacts inserted into the cavity, each having a mating portion, a tail and an intermediate portion joining the mating portion and the contact tail; and d) insulative material placed in the cavity to secure the signal contacts to the first housing, while leaving the mating portions and the tails of the signal contacts exposed, wherein the wafers are stacked side by side with the first insulative housing provided in the recess of one wafer adjacent the exposed mating portions of the signal contacts in an adjacent wafer, and wherein the shield plate has a plurality of attachment features therein and molding the first insulative housing comprises molding insulation over a first portion of the attachment features and placing insulative material in the cavity comprises molding a second insulative housing around a second portion of the attachment features.

7. An electrical connector made from a plurality of wafers, comprising:

a) a shield plate with an upper surface and a lower surface, the plate having raised portions in the upper surface thereby forming recesses in the lower surface;

b) a first insulative housing molded on the upper surface of the shield plate and the lower surface of the shield plate in the recesses, the insulative housing having a cavity therein;

c) signal contacts inserted into the cavity, each having a mating portion, a tail and an intermediate portion joining the mating portion and the contact tail; and d) insulative material placed in the cavity to secure the signal contacts to the first housing, while leaving the mating portions and the tails of the signal contacts exposed, wherein the wafers are stacked side by side with the first insulative housing provided in the recess of one wafer adjacent the exposed mating portions of the signal contacts in an adjacent wafer, wherein portions of the shield plate are bent at right angles to the plate to form slots and a contact elements adjacent the slots, and wherein the molding a first insulative housing leaves each of the contact elements exposed.

* * * * *